US009804568B2

(12) United States Patent
Paratte

(10) Patent No.: US 9,804,568 B2
(45) Date of Patent: Oct. 31, 2017

(54) MECHANISM FOR REGULATING THE RATE OF A TIMEPIECE OSCILLATOR

(71) Applicant: The Swatch Group Research and Development Ltd, Marin (CH)

(72) Inventor: Lionel Paratte, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/208,131

(22) Filed: Jul. 12, 2016

(65) Prior Publication Data

US 2017/0017205 A1 Jan. 19, 2017

(30) Foreign Application Priority Data

Jul. 16, 2015 (EP) ..... 15176957

(51) Int. Cl.
*G04B 18/00* (2006.01)
*G04B 18/02* (2006.01)
(Continued)

(52) U.S. Cl.
CPC ..... *G04B 18/02* (2013.01); *G04B 18/006* (2013.01); *G04D 7/084* (2013.01); *G04D 7/087* (2013.01); *G04D 7/1264* (2013.01)

(58) Field of Classification Search
CPC .... G04B 18/00; G04B 18/006; G04D 7/1264; G04D 7/087; G04D 7/08; G04D 7/084
See application file for complete search history.

(56) References Cited

U.S. PATENT DOCUMENTS 8,414,184 B2 * 4/2013 Mallet ..... G04B 17/063 368/127
2012/0207001 A1 * 8/2012 Pittet ..... G04B 17/30 368/243
(Continued)

FOREIGN PATENT DOCUMENTS

CH 504 030 9/1970
EP 2 410 386 A1 1/2012
(Continued)

OTHER PUBLICATIONS

Translation of claimed—EP 3118693—Jun. 19, 2017.*
(Continued)

*Primary Examiner* — Sean Kayes
(74) *Attorney, Agent, or Firm* — Oblon, McClelland, Maier & Neustadt, L.L.P.

(57) ABSTRACT

A microsystem for setting the rate of a timepiece oscillator, including a wheel/inertia block including an off-center unbalance and a toothing and arranged to pivot with respect to a base plate of the microsystem, which includes an actuator driving a first active click arranged to drive the toothing, and includes a device for stopping the toothing in position, wherein the actuator is a thermomechanical actuator arranged to convert a flow of light energy into a displacement of a distal end of the thermomechanical actuator, which carries a first active click or directly controls a movement of a first active click, and the microsystem is capable of incorporation in a watch including a crystal transparent to predetermined wavelengths ranges and allowing the passage of a light ray to regulate the microsystem.

28 Claims, 5 Drawing Sheets

(51) Int. Cl.
*G04D 7/08* (2006.01)
*G04D 7/12* (2006.01)

(56) References Cited

U.S. PATENT DOCUMENTS

| | | | | |
|---|---|---|---|---|
| 2013/0188461 | A1 | 7/2013 | Mallet et al. | |
| 2014/0286143 | A1* | 9/2014 | Stranczl | G04B 18/025 368/178 |
| 2015/0168922 | A1* | 6/2015 | Wanikawa | H01L 31/042 136/244 |
| 2016/0164450 | A1* | 6/2016 | Vergara Monsalve | F24J 2/07 60/641.15 |

FOREIGN PATENT DOCUMENTS

| | | |
|---|---|---|
| FR | 1 345 549 | 12/1963 |
| JP | 2013-195297 | 9/2013 |
| WO | WO 2015/140332 A2 | 9/2015 |

OTHER PUBLICATIONS

European Search Report dated Mar. 4, 2016 in European application 15176957.7, filed on Jul. 16, 2015(with English Translation).

* cited by examiner

MECHANISM FOR REGULATING THE RATE OF A TIMEPIECE OSCILLATOR

This application claims priority from European Patent Application No. 15176957.7 filed on Jul. 16, 2015, the entire disclosure of which is hereby incorporated herein by reference.

FIELD OF THE INVENTION

The invention concerns a microsystem for setting the rate of a timepiece oscillator, comprising at least one wheel/inertia block arranged to pivot with respect to a base plate comprised in said microsystem, said wheel/inertia block comprising an off-centre unbalance and comprising a toothing, said microsystem comprising at least one actuator arranged to drive a control wheel, a lever, or click wheel, said active click being arranged to drive said toothing, and said microsystem comprising at least one means for stopping said toothing in position.

The invention also concerns a timepiece oscillator comprising at least one such microsystem.

The invention also concerns a timepiece movement comprising at least one such oscillator.

The invention also concerns a watch comprising at least one such microsystem or one such oscillator.

The invention also concerns a device for setting the rate of a timepiece oscillator comprising at least one such watch.

The invention concerns the field of regulation of timepiece oscillators, and more specifically for mechanical movements.

BACKGROUND OF THE INVENTION

Adjusting the rate of a mechanical watch is a specialist task, and requires meticulous, precise and careful work.

To adjust the rate of a mechanical watch, it is generally necessary to open the case and remove the movement, to obtain access to the components that allow the rate to be adjusted, and in particular, in the normal case of an oscillator comprising a sprung balance assembly, where the oscillation frequency depends on the inertia of the balance and on the stiffness of the balance spring, to the components enabling these two parameters to be acted on:

- screws on the arms or the rim of the balance, which can be rotationally adjusted to modify the inertia of the equipped balance,
- a rotationally movable index arranged to modify the stiffness of the balance spring,
- or similar elements.

This operation therefore requires additional time-consuming operations. Moreover, it is also necessary to recheck the sealing. Often, the operation of replacing the movement in the case produces another offset in rate, which means that the adjustment must be repeated.

EP Patent Application 2410386 A1 in the name of NIVAROX-FAR SA discloses an equipped balance for a timepiece, with inertia adjustment for setting the inertia and/or poising and/or oscillation frequency of the balance, with a balance comprising an insert placed in a recess in a rim connected to a hub by a joining surface. This balance or insert is equipped with elastic holding means allowing the insertion, under stress, of the insert into its housing, and preventing, once released after the complete insertion of each insert, the removal of any insert from its housing. These elastic holding means can be made directly in the balance rim.

SUMMARY OF THE INVENTION

The invention proposes to allow a mechanical watch function to be finely or roughly set, and more particularly the rate of mechanical watch movement to be finely adjusted, without having to open the watch case.

The invention proposes to utilise the properties of energy transport by a light ray or laser or suchlike inwardly of the watch case, to reversibly deform some areas of the oscillator.

To this end, the invention concerns a mechanism for setting the rate of a timepiece oscillator according to claim 1.

The invention also concerns a timepiece oscillator comprising at least one such microsystem, according to claim 20.

The invention also concerns a timepiece movement comprising at least one such oscillator, according to claim 22.

The invention also concerns a watch comprising at least one such microsystem or at least one such oscillator, according to claim 23.

The invention also concerns a device for setting the rate of a timepiece oscillator, comprising at least one such watch, according to claim 24.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
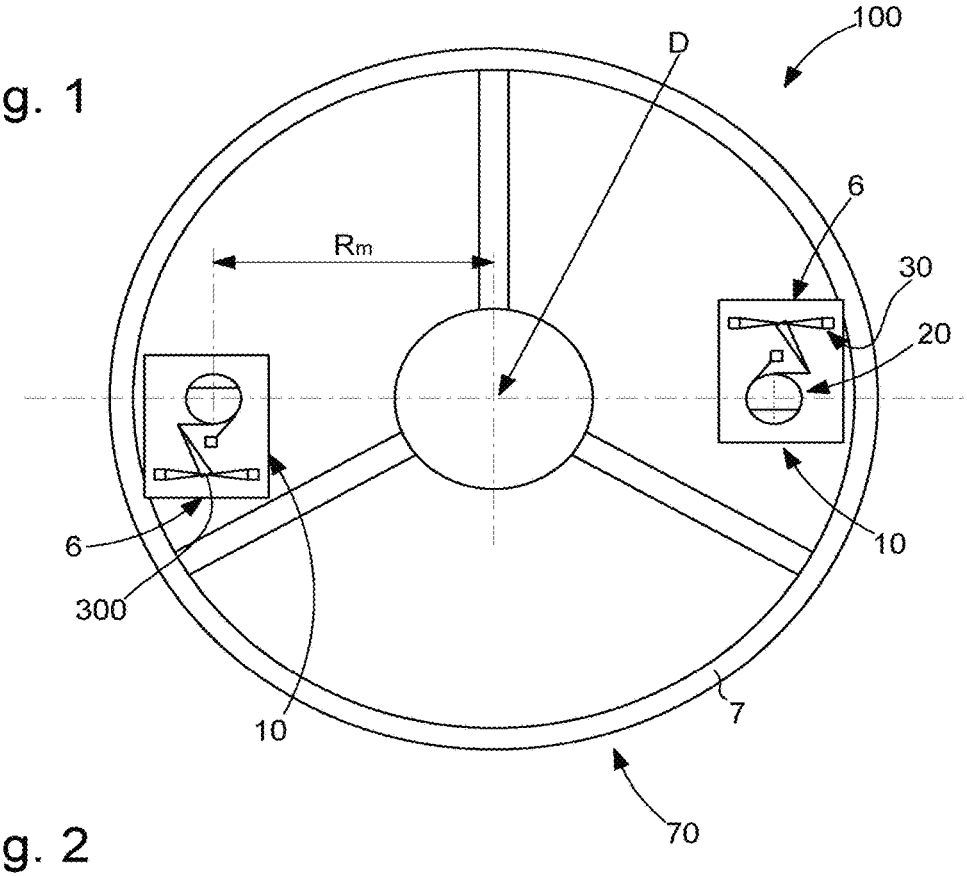
FIG. 1 shows a schematic front view of an equipped balance for a timepiece oscillator mechanism, which comprises, carried by a balance rim, two microsystems according to the invention arranged to convert a flow of light energy, concentrated in at least one heating area, into a variation in the inertia of the equipped balance, by changing the distribution in space of the weights of which the balance is composed.

The invention proposes to allow a horological function to be adjusted or set, in particular adjustment of the rate of a mechanical timepiece movement, without having to open the case 90 of a watch 1.

Depending on the construction and dimensions of the mechanism according to the invention and depending on the required use, it is possible to perform a fine or rough adjustment. The invention is, in fact, more precisely devised for a microadjustment, in order to vary precisely adjust the rate of a watch with its movement cased up in its final configuration, and the example dimensions which will be given hereinafter are suitable for such a fine adjustment. Those skilled in the art will know how to extrapolate the architecture of the invention to perform adjustments requiring greater adjustment amplitude.

To this end, the invention concerns a device 1000 for setting a timepiece function, notably setting the rate of a timepiece oscillator 100, particularly for a mechanical movement 200.

Movement 200 is not illustrated in detail in the Figures.

Oscillator 100 is not completely illustrated. It is formed, in a particular but non-limiting case, by a sprung balance assembly, and only equipped balance 70 is represented in the Figures. The invention illustrated in this particular application concerns modification of the inertia of a timepiece balance, or modification of the position of the centre of inertia (correction of unbalance).

Indeed, in a preferred variant illustrated by the Figures, as will be seen hereinafter, the invention uses the rotation of one or more wheel/inertia blocks with eccentric parts, indirectly affixed to the balance inside optically controlled microsystems 10, each having a base plate 60 secured on a bare balance 7, or in one-piece with bare balance 7: the invention allows the angular position of each wheel/inertia block to be modified, and thus the position of the centre of inertia specific to the wheel/inertia block to be changed, with respect to the main pivot axis D of balance 7.

The overall inertia of equipped balance 70, comprising the bare balance and the microsystem or microsystems 10, may therefore remain unchanged in some cases, if the centre of inertia of the wheel/inertia block remains on the same radius with respect to the main pivot axis D of the balance, whereas the resulting position of the centre of inertia may be modified. It is understood that, if several microsystems are introduced, depending on the arrangement thereof, it is possible either to subject them to a symmetrical manoeuver that does not change the position of the overall centre of inertia, or to control them independently of each other, and thus modify the position of the overall centre of inertia, and thereby also enable any intrinsic out-of-poise of the bare balance to be corrected. The expression "modification of inertia" will be used hereinafter to designate both the modification of inertia value with respect to an axis, and the modification of the resulting position of the centre of inertia of a mobile part with respect to such axis.

The invention proposes to utilise the properties of energy transport by a light ray or laser or suchlike, inwardly of the watch case 90, to reversibly deform some areas of the oscillator 100.

Those skilled in the art of oscillators having a sprung balance assembly, or oscillators having a balance wheel/torsion wire assembly which are much rarer, will know how to extend the teachings of the invention to cause controlled micromovements, so as to modify the stiffness of a balance spring or the tension of a torsion wire, either directly, or indirectly by acting on the means for attaching or tensioning such elastic return means.

The invention is illustrated with a modification of inertia on part of the oscillator formed by a balance wheel. Those skilled in the art will know how to extend the use of optically controlled microsystems 10, such as those described in detail hereinafter, to act on another component of an oscillator, to adjust such attachment or tensioning means, means for modifying the stiffness of a balance spring or adjusting the useful length of a balance spring, or other means.

The invention firstly concerns a microsystem 10 for setting a timepiece function, and, more particularly in the application illustrated by the Figures, a microsystem for setting the rate of a timepiece oscillator, notably for a mechanical movement.

The invention utilises energy transfer by optical means, to cause a motion of a mechanical adjustment component.

The invention preferably concerns high-end watches, having a transparent case back 2, arranged to be transparent to certain desired wavelength ranges, to allow the passage of a light ray 3, or any other optical beam. Of course, the passage of light may also occur, notably for a skeleton movement, from the upper side of the case that comprises the crystal and can be read by the user, or through a side or peripheral edge of case 90. In a variant that is not illustrated, it is also possible for the light path in watch 1 to be made along an optical fibre or a waveguide, which then allows for a non-rectilinear light path.

The invention is thus illustrated in a particular non-limiting variant, wherein a light beam 3 can pass through a case back crystal 2 transparent to selected wavelengths, so as to illuminate an illuminated area 5, preferably on at least one peripheral sector of an equipped balance 70.

This equipped balance 70 comprises a bare balance 7 connected to an elastic return means, such as a balance spring or torsion wire, or moving in an environment of magnetic or electrostatic fields of attraction and/or repulsion, and bare balance 7 carries at least one micro-system 10, which is arranged to convert a concentrated light energy flow into a variation in the inertia of equipped balance 70, by modifying its inertia and the distribution in space of the weights of which it is formed.

More particularly, if illuminated area 5 can cover the entire surface of such microsystems 10, the concentrated light beam, which is obtained with optical concentration means 4, is directed towards at least one heating area 6 of an actuator comprised in such a microsystem 10, after passing through case back crystal 2. As will be seen hereinafter, this actuator is advantageously a thermomechanical actuator 30.

Figure 2:
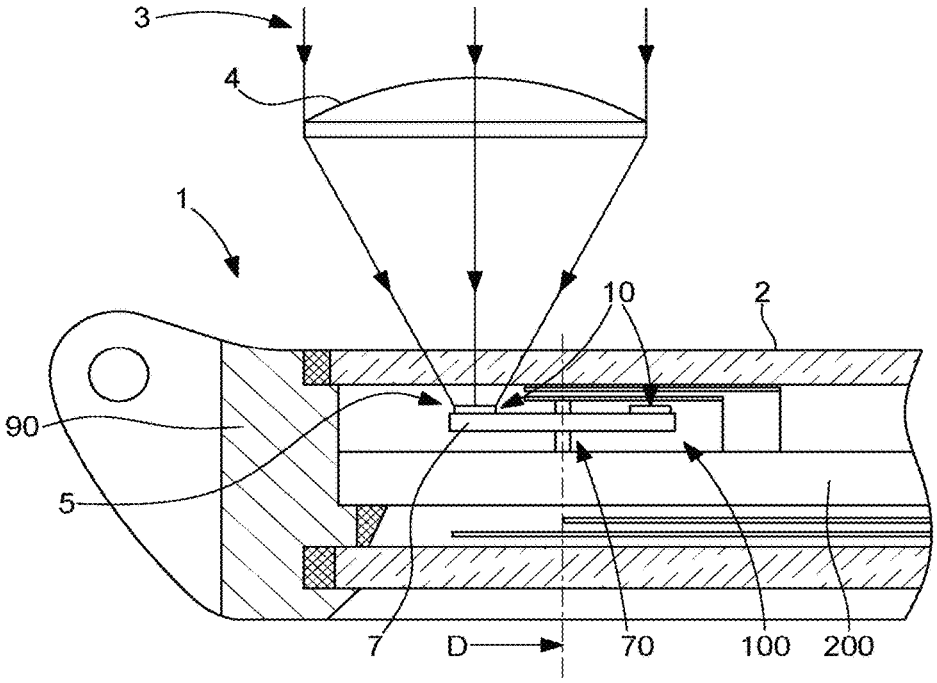
FIG. 2 shows a partial schematic cross-sectional view of a watch comprising a case closed by a transparent back cover, which case contains a movement comprising a mechanical oscillator of which only the equipped balance of FIG. 1 is illustrated, one part of the surface of which is located in an area illuminated by a light ray from an external source, concentrated by a lens, and passing through the transparent back cover of the case.

Optical concentration means 4 are not described in detail, and are either integral to watch 1, such as lenses, or external to watch 1 as in FIG. 2, which shows a lens arranged to concentrate the heat energy from a light ray 3 towards a heating area 6.

In the preferred application of the invention to an equipped balance 70 and as seen in the Figures, the inertia of the balance is modified by the addition of at least one microsystem 10 allowing the inertia of the balance to be changed, and preferably by the addition of a plurality of such microsystems 10.

The invention is illustrated in the Figures by an advantageous variant comprising two identical rotating microsystems 10, arranged diametrically and symmetrically on the rim of bare balance 7, with respect to the main pivot axis D thereof, so that the unbalance effect of one of rotating microsystems 10 offsets the other.

In an advantageous embodiment illustrated by the Figures, microsystem 10, notably for setting the rate of a timepiece oscillator, comprises at least one wheel/inertia block 20 arranged to pivot with respect to a base plate 60 comprised in microsystem 10. Wheel inertia block 20 comprises an off-centre unbalance 22 and includes a click toothing 21. According to the invention, microsystem 10 comprises at least one actuator driving at least a first so-called active click 38 arranged to drive in rotation toothing 21, and comprises at least one means for stopping toothing 21 in position.

In a particular non-limiting embodiment illustrated by the Figures, microsystem 10 comprises a base plate 60, an actuator, which is a thermomechanical actuator 30 provided with a first so-called active click 38, and a wheel/inertia block 20 with a click having an off-centre unbalance and pivoting about a secondary axis D20.

Naturally, the invention may be achieved with secondary mobile parts having a different form to the illustrated wheel/inertia blocks 20, for example taking the form of weights moving in grooves or suchlike.

Thermomechanical actuator 30 may, depending on the selected variant embodiment, be attached to base plate 60, or in one-piece therewith.

Figure 4:
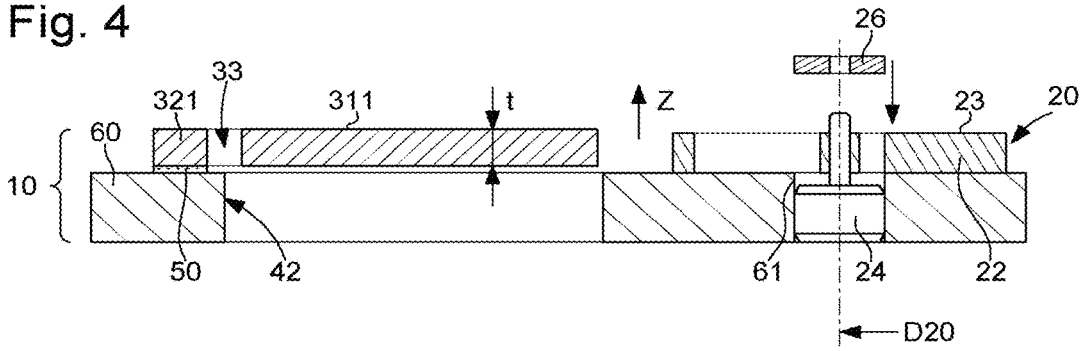
FIG. 4 is a cross-sectional view along the line AA of the microsystem of FIG. 3.

Wheel/inertia block 20 may, depending on the selected variant embodiment, be guided in base plate 60, or in one-piece therewith. In a first variant, at least one wheel/inertia block 20 is mounted to pivot about a fixed arbor 24 affixed to base plate 60 or integral with said base plate 60, and pivoting about secondary axis D20: wheel/inertia block 20 shown in FIG. 4 pivots about a fixed guide arbor 24, driven or bonded in a bore 61 of base plate 60. In a second variant, not illustrated by the Figures, at least one wheel/inertia block 20 is incorporated in base plate 60, with respect to which it pivots, carried by monolithic articulated structures or flexible bearings, notably of the thin elastic strip type.

In a variant illustrated by the Figures, the means for stopping toothing 21 in position is a second so-called passive click 25 which is positioned on base plate 60 and includes an elastic return means, for bearing on toothing 21.

In the non-limiting variant illustrated by the Figures, the first active click 38 is a click mounted tangentially to toothing 21, and comprises at least one tooth or one comb returns towards said toothing 21 by an elastic return means comprised therein. Other embodiments may be envisaged, depending upon the space available, the first active click may also be a control wheel, a lever, a click wheel or other element.

According to the invention, advantageously, at least one actuator of microsystem 10 is a thermomechanical actuator 30, which is arranged to convert a light energy flow into a displacement of a mechanical control member. Thermomechanical actuator 30 is devised to convert concentrated light energy into a displacement CC, and notably into a displacement which may be similar to a linear displacement. In particular, in the embodiment illustrated by the Figures, displacement CC concerns a distal end 380 of thermomechanical actuator 30. This distal end 380 carries a first active click 38, or directly controls a motion of such a first active click 38 by means of a gear train, a friction gear, a rod mechanism or suchlike.

Such a thermomechanical actuator 30 may also be used, in the same form, for other applications for controlling a timepiece adjustment device.

Thermomechanical actuator 30 comprises a mobile part 300 that is deformable, specifically by the action of the heat of the light ray, which acts more particularly on the neck portions or ball joint type portions 34, 35, 36.

Preferably and as seen in the Figures, thermomechanical actuator 30 comprises, substantially in a first longitudinal direction X, and in the following order: a longitudinal line composed of alternating stiff weights 311, 45, 46, 312, and flexible neck portions 34, 35, 36, maintained between anchor elements 321, 322 on base plate 60, the opposite outer stiff weights 311, 312, called arms, resting on these anchor elements 321, 322 or being integral with anchor elements 321, 322.

In the particular and non-limiting variant illustrated, deformable mobile part 300 includes two arms 31: 311 and 312, extending substantially in the same longitudinal direction X, and anchored, at their opposite farthest ends 320, to anchor elements 32: 321, 322, made integral with base plate 60, for example by means of an oxide layer 50 in the advantageous case of a silicon embodiment.

These two arms 311 and 312 surround a central portion which includes a first solid part 45 and a second solid part 46.

The first solid part 45 is connected to a first arm 311 by a first neck portion 34 and a second solid part 46 by a second neck portion 35 called the central neck portion. The second solid part 46 is connected to a second arm 312 by a third neck portion 36.

Arms 311, 312, neck portions 34, 35, 36, and first solid part 45 and second solid part 46 are, at rest, substantially aligned along longitudinal direction X.

A central area of thermomechanical actuator 30, comprising at least neck portions 34, 35, 36, is arranged to be superposed on a heating area 6 where the central area can receive an application of light energy. The brief difference in temperature between the hot central area and its cold support causes an expansion of the central area, which has the effect of compressing the longitudinal line between anchor elements 321, 322, and of causing at least one of said neck portions (34, 35, 36) to bend. This compression tends to subject the neck portions to a bending force; in order to maintain substantially plane deformations, the total thickness of the actuator, in a direction perpendicular to the plane of base plate 60, is sizable with respect to the thickness of the neck portions in this plane, for example thirty times larger. Thus, the effect of the compression is a deformation of all the neck portions 34, 35, 36. When the entire microsystem 10 is subjected to a temperature variation, for example when the watch comprising such a microsystem 10 is exposed to the sun, thermomechanical actuator 30 will not move, if it is made of the same material as base plate 60. This constitutes an incontestable advantage with respect to bi-metallic attachment systems, for example.

At least one of flexible neck portions 34, 35, 36 is offset, in a transverse direction Y orthogonal to longitudinal direction X, by a transverse offset dy with respect to the other neck portions 34, 35, 36, converting the bending motion of at least one of neck portions 34, 35, 36 into a plane rotational motion, parallel to base plate 60, of at least one intermediate weight 45, 46, not directly connected to one of anchor elements 321, 322.

In the variants illustrated, an intermediate weight 45 or 46, which is driveable in rotation, carries a stick 37 extending substantially in transverse direction Y and comprising a distal end 380 arranged to carry a mechanical control means. Preferably, the rotational travel of stick 37 is limited by stick stops 39 which surround it.

When an adjustment device 1000 according to the invention is used, for a watch 1 equipped as described hereinbefore, and for application to adjustment of the rate of an oscillator 100 comprising an equipped balance 70, the balance is first immobilised in a position that visibly exposes both microsystems 10, or one microsystem after the other, to the application of energy from a light ray 3. In a variant, device 1000 comprises synchronizing means for controlling a light ray 3 to follow the motion of and to target at least one, or each, microsystem 10 comprised therein, borne by a component of oscillator 100 during its oscillation, notably on equipped balance 70 during its oscillation.

To operate the system, a light ray 3 is projected through transparent case back 2 and is concentrated, in a heating area 6, on a specific portion to be heated, formed by the central area of thermomechanical actuator 30. The latter is deformed, and first active click 38, which is integral with a movable part of thermomechanical actuator 30, and more specifically with stick 37, drives toothing 21 of wheel/inertia block 20 over one or more teeth. The displacement of the centre of gravity 23 (or inertia) of wheel/inertia block 20 thus causes a change in the inertia of equipped balance 70.

It is understood that the driving by first active click 38 occurs in only one direction, which is the clockwise direction in the case of FIG. 2, the second passive click 25 then prevents rotation in the anticlockwise direction during the return of first active click 38 when the central area cools.

Various modes of use may be envisaged, those described hereinafter as examples are not restrictive.

In a first mode, the duration of illumination of the heating area is as short as possible, and is limited to obtaining the desired deformation of actuator 30, preferably corresponding to the passage of only one tooth of toothing 21. If the passage of several teeth is required, it is possible to allow the actuator to return more rapidly to ambient temperature, in a neutral position, and to illuminate it again for the passage of one tooth, and to repeat this operation as many times as necessary. This does not exclude operation with illumination maintained for the simultaneous passage of several teeth; first active click 38 may comprise, instead of a single tooth as shown in the Figures, a comb or similar element.

Of course, a single tooth on first active click 38 may also act on more than one step, and has the advantage of preventing any jamming. To effect several clicks, i.e. jumps made by passive click 25, for a single return travel of first active click 38, it is possible to act on the distance between the centres of stops 39 to obtain, for example, two or three clicks at most before a stop, and one or two clicks without abutting a stop, but by acting on the illumination time.

In a second mode, the illumination is maintained: after a significantly longer time than in the first mode, the heat flow towards the base is steady, and the respective temperatures of the central area and of base plate 60 come closer to each other, causing the actuator to be set in operating position again.

In another embodiment using both the aforecited heating modes, an indirect application of heat is effected, the concentrated light ray then heating a buffer component, for example a ring, in front of which the central area of actuator 3 passes during oscillation of the balance.

Another embodiment uses an on board ring which is securely connected to the central area to be heated, which allows the heating spot to remain immobile.

It is also possible to combine the movable heating with a target buffer inserted in and integral with the central area, but having a larger surface area, and allowing for more efficient thermal coupling with the light spot.

Heating area 6 is preferably arranged to cover at least the central part with neck portions 34, 35, 36, and first solid part 45 and second solid part 46, and the inner ends of arms 311, 312. By the action of the heat, arms 311 and 312 are elongated when the temperature increases, and are subjected to a compression stress. The three neck portions 34, 35, 36 make the system compliant, not hyperstatic.

Figure 9:
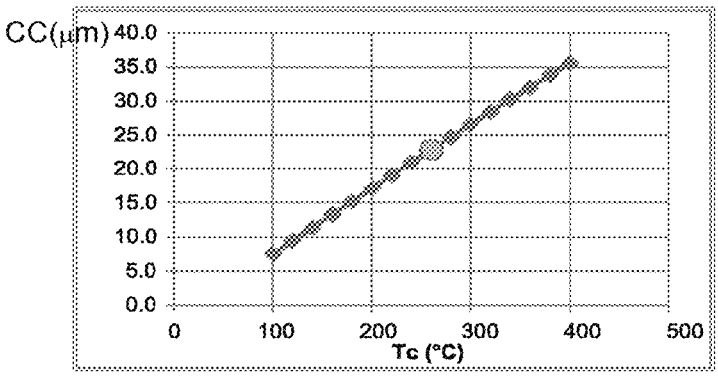
FIG. 9 is a curve showing the quasi-linear travel path of the distal end of the lever, corresponding to the travel of the first active click, as a function of the difference in temperature between the heating area and the base plate.
Figure 10:
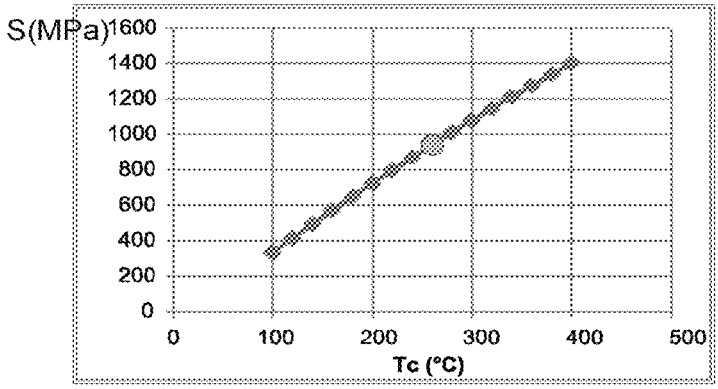
FIG. 10 is a similar curve showing the quasi-linear change in stress in the neck portions, as a function of temperature.

The slight transverse offset "dy" of at least one of neck portions 34, 35, 36 in relation to the others, is sufficient to subject at least first solid part 45 or second solid part 46 to a rotational motion parallel to the plane of base plate 60. Only a very small difference is sufficient to initiate the rotational motion which can then be correlated with the application of heat and the temperature in heating area 6, to adjust in a quasi-linear manner the angle of rotation 9 of stick 37, and the displacement CC of first active click 38, as seen in FIG. 9. FIG. 10 shows that the stress S in the neck portions obeys an almost identical rule, with a substantially linear curve as a function of temperature.

Figure 5:
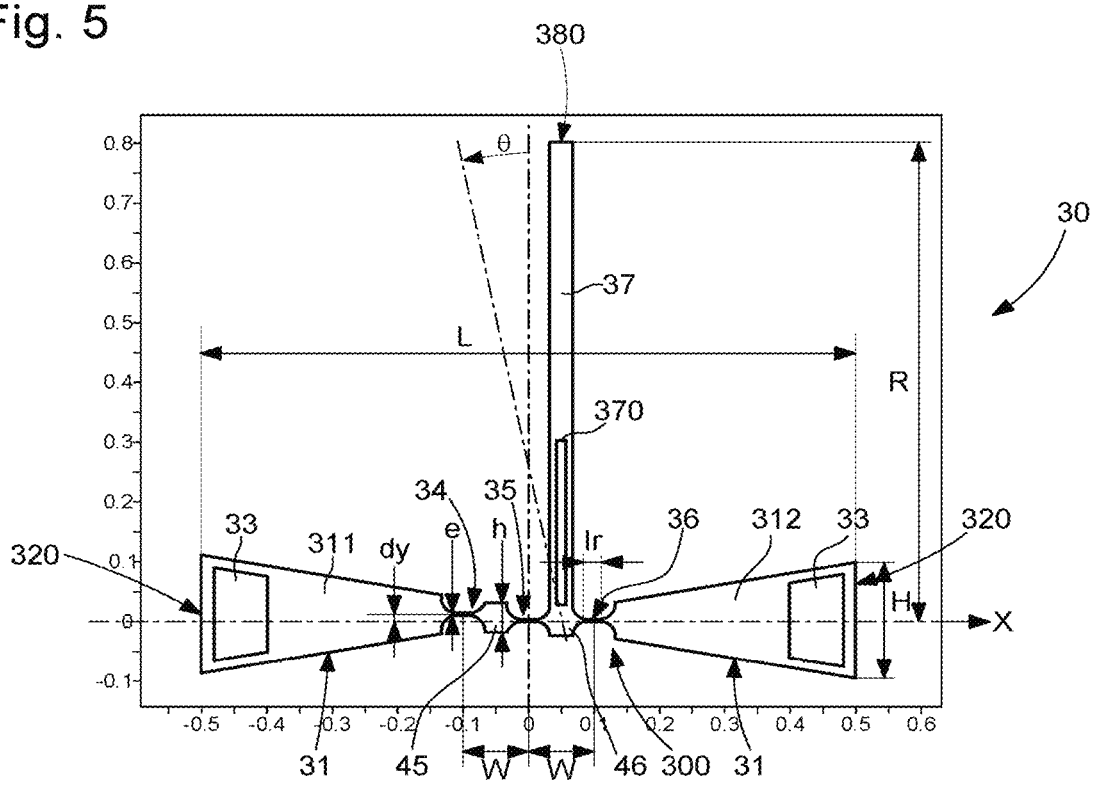
FIG. 5 represents a variant of the thermomechanical actuator of FIG. 3, which is T-shaped and devoid of counterweights in the extension of the lever, and with a slight transverse offset of the longitudinal arms in a different configuration from FIG. 3.

FIG. 9 illustrates that subjecting heating area 6 to a temperature close to 260° C., in the illustrated example which corresponds to the FIG. 5 variant, can produce an amplitude of displacement CC of 23 μm, which is sufficient to drive toothing 21 of a wheel/inertia block 20, which is advantageously also made of silicon. It is understood that the pronounced slope of the profile in FIG. 9 can, if necessary, increase the travel of active first click 38, while monitoring the degree of stress in FIG. 10.

Figure 3:
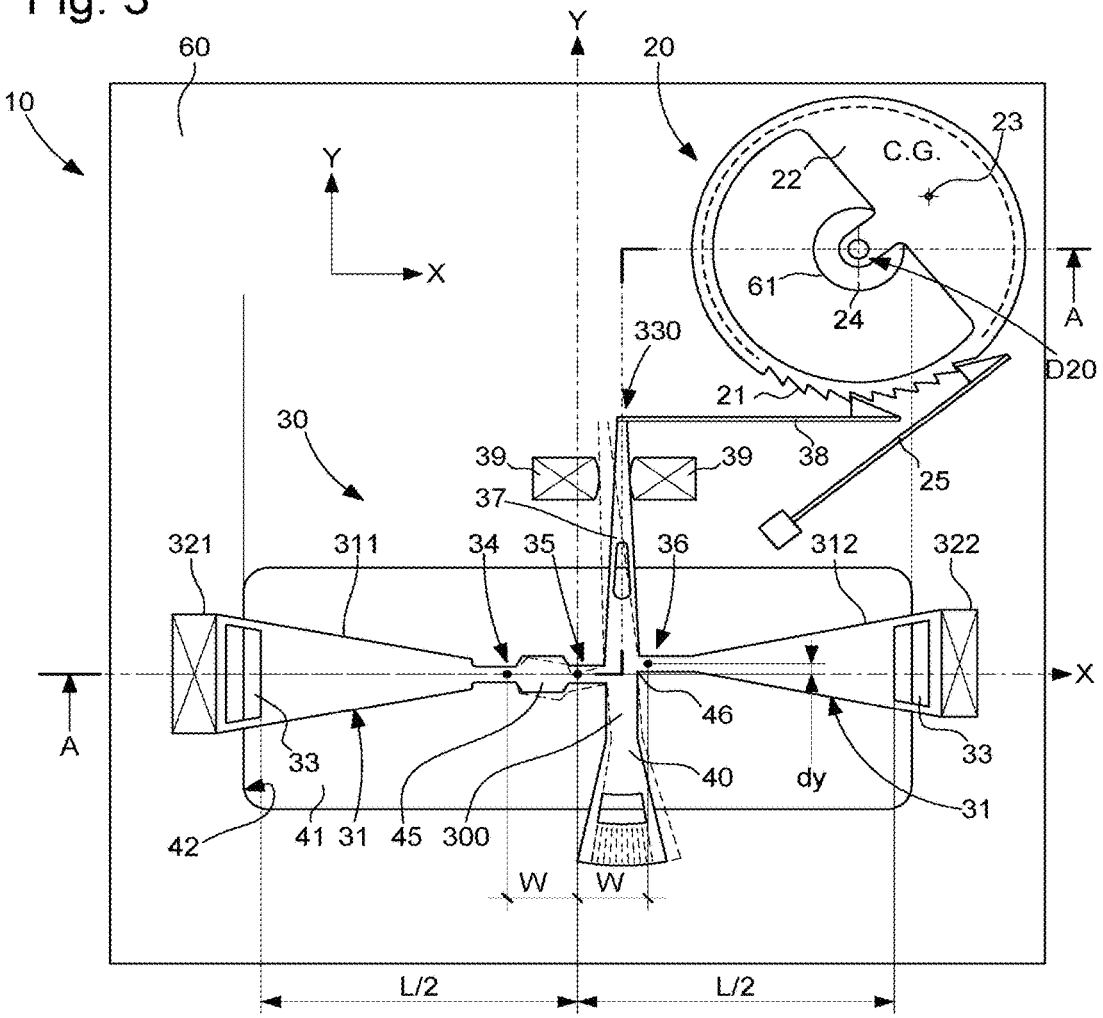
FIG. 3 shows a schematic front view of a microsystem according to the invention, comprising a thermomechanical actuator fixed on a base plate, formed by a deformable mobile part in the form of a cross having two longitudinal arms, connected to each other by alternating neck portions and weights, and slightly transversely offset in relation to each other, which form the support on the base plate, and having a transverse arm, called the lever, carrying a first so-called active click, which is arranged to drive a toothing of a wheel/inertia block with an off-centre unbalance mounted to pivot with respect to the base plate, and having another free cantilever transverse arm which forms a poising counterweight.

FIGS. 3 and 5 illustrate the same embodiment, with different details of implementation. These two variants have a common feature, which consists in pivoting virtually on the spot the second solid part 46, which carries a stick 37 that extends substantially in transverse direction Y, and carries, at the distal end 380 thereof, first active click 38.

The FIG. 3 variant includes stick stops 39, arranged to limit the travel of first active click 38 to 1.5 teeth of toothing 21 of wheel/inertia block 20.

In this FIG. 3 variant, thermomechanical actuator 30 carries, substantially in the extension of stick 37 and on the opposite side with respect to a line defined by anchor elements 321, 322, at least one counterweight 40 intended to prevent the movement of stick 37 in the event of shocks, and to prevent any alteration of the oscillation frequency and rate adjustment.

In the two variants of FIGS. 3 and 5, the central area comprises the inner ends of two arms 311, 312, directly attached via their outer ends to anchor elements 321, 322, wherein these inner ends are separated by recesses 33 arranged to insulate the bases 320 of the arms and anchor elements 321, 322 from the hot area, when the central area is subjected to an energy flow. The central area also comprises the inner end of the stick 37, which is separated from distal end 380 by a cavity arranged to insulate the distal end 380 from the hot area when said central area is subjected to an energy flow.

The central area may also comprise the inner end of counterweight 40, which is separated from its distal end by a cavity arranged to insulate the distal end from the hot area.

As seen in FIG. 3, base plate 60 advantageously comprises at least one cavity 41, delimited by an edge portion 42, arranged to insulate anchor elements 321, 322, and each wheel/inertia block 20 from the hot area when the central area is subjected to an energy flow.

FIG. 1 is an overview with an equipped balance 70 having a diameter of around 10 mm, which carries two microsystems 10, each made on the basis of an SOI chip with sides around 1.6 mm long, carrying wheel/inertia blocks 20 having a diameter of around 0.7 mm, i.e. a radius of action Rm of around 4 mm, each heating area 6 being a disc with a diameter of around 0.8 mm.

Figure 11:
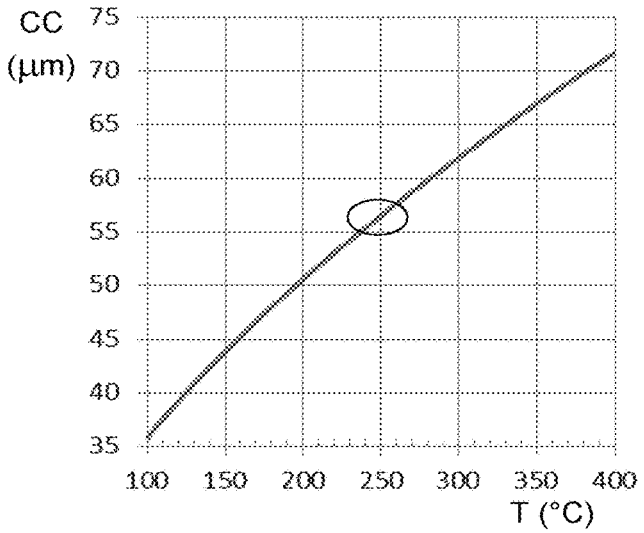
FIG. 11 is the equivalent of FIG. 9 for the actuator of FIG. 3.
Figure 12:
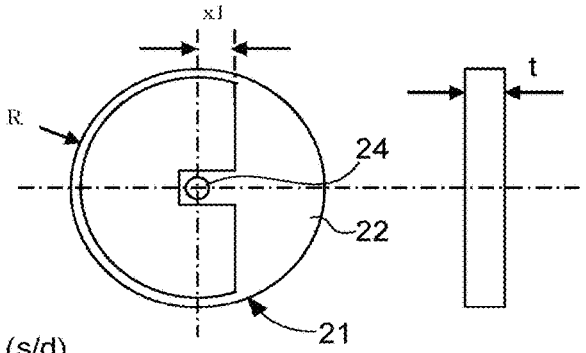
FIG. 12 is a detail of a wheel/inertia block.
Figure 13:
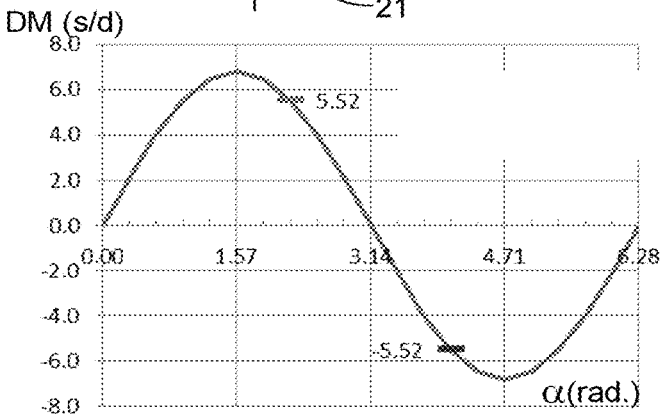
FIG. 13 is a curve showing the variation of rate which is a sinusoidal function of the angle of rotation of the wheel/inertia block.
Figure 14:
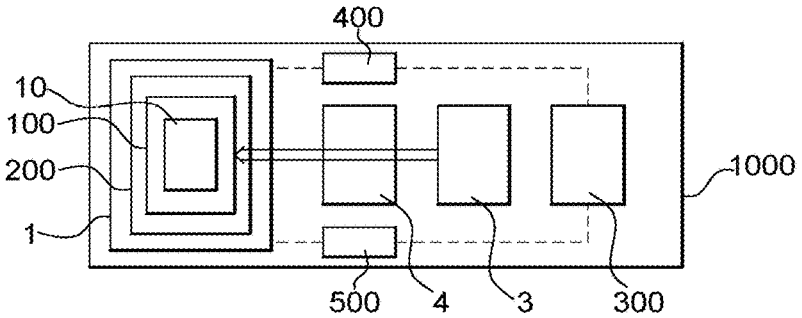
FIG. 14 is a block diagram representing a device for setting the rate of a timepiece oscillator, comprising a watch with a movement comprising an oscillator provided with a microsystem according to the invention, this device comprising control means interfaced with rate monitoring means and temperature monitoring means, arranged in proximity to the watch case.

FIGS. 11 to 13 relate to the microsystem 10 of the S-shaped design variant, made in single crystal silicon MEMS technology, of FIG. 3, in a non-limiting numerical example, with a length L of 1.0 mm, a rod length w, characteristic of the distance between the areas of curvature of two successive neck portions, of 0.100 mm, an expansion coefficient of $2\cdot10^{-6}/°$ C., and a radius R of rotation of the click of 0.8 mm. FIG. 11 shows that around the nominal point dT=250° C., the travel of 57 μm corresponds to one click. In this simplified numerical example, the stiffness of neck portions 34, 35, 36 is very low, at least a hundred times lower than that of base plate 60.

The dimensions of microsystem 10 are preferably created in accordance with the following principles:

- offset dy must be sufficiently high to provide enough force at the start of motion, which is determined by the friction of wheel/inertia block 20, but offset dy must be as small as possible;
- the height h, in transverse direction Y, of first solid part 45 and of second solid part 46 must be sufficiently high with respect to the height e, in transverse direction Y, of the flexible elements formed by neck portions 34, 35, 36, for the latter to act as ball joints;
- the ratio lr/e of neck portions 34, 35, 36 forming ball joints must be sufficiently high not to generate excessive material stresses, and sufficiently low not to cause unstable equilibrium along transverse axis Y, particularly in the event of shocks;
- a high ratio L/w increases the rotation of stick 37, and thus travel CC, for a given temperature difference;
- a high distance R increases the travel accordingly, but decreases the force at distal end 380 accordingly, for a given angle of rotation;
- the thickness t of the actuator must be sufficiently large to prevent vertical buckling of any part of length L. The ratio t/e should have a value of at least three, for neck portions 34, 35, 36 acting as ball joints to have advantageous compliance in the plane parallel to base plate 60 and to remain stiff outside the plane.

Thus, in a particular non-limiting example and as seen in FIG. 5, neck portions 34, 35, 36 comprise a linear portion whose length "lr" is approximately four times the thickness "e" of the neck portions, and the offset "dy" provided to initiate the rotation of stick 37 is approximately two times said thickness "e". The height "h" of first solid part 45 and of second solid part 46 is preferably comprised between two and three times the swivel length "lr" and close to half the rod length "w".

The 3 ends of actuator 30 are maintained at an ambient temperature of around 20° C. Heating area 6 may be brought to a temperature comprised between 100 and 400° C., the upper limit being selected as a function of the materials of watch 1, notably of case 90, to prevent any component damage. This precaution also explains why heating area 6 is restricted to the smallest possible surface area.

Figure 6:
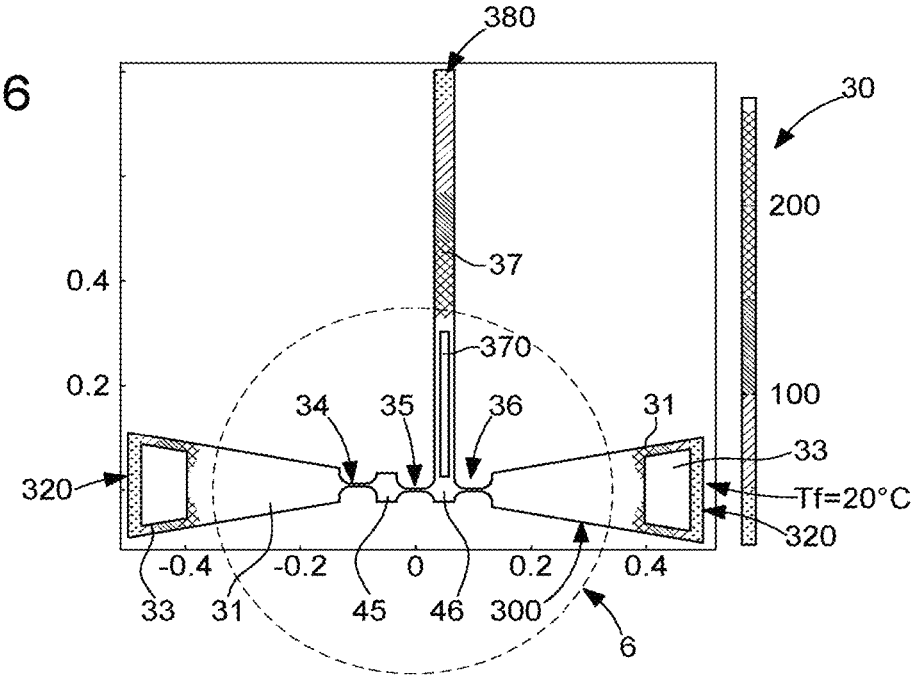
FIG. 6 is a temperature distribution diagram of the actuator of FIG. 5 when the farthest ends of the longitudinal arms and the distal end of the lever are maintained at ambient temperature, whereas the central area comprising the neck portions is placed in a heating area at a high temperature comprised between 150° C. and 300° C.
Figure 7:
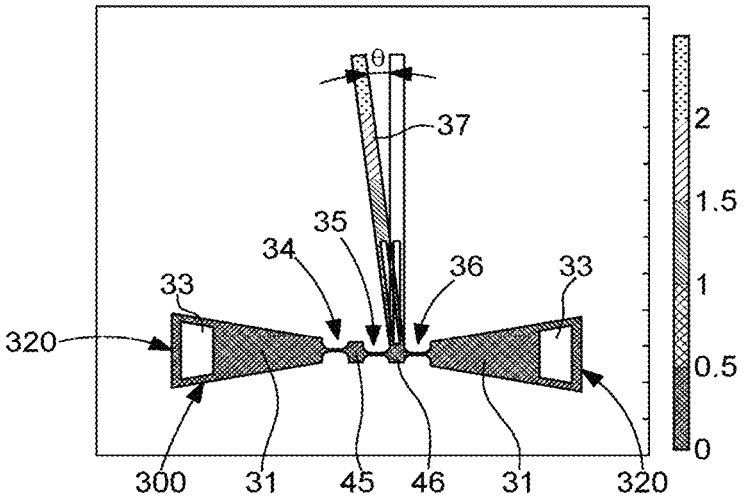
FIG. 7 shows a schematic front view of the deformation of the thermomechanical actuator of FIG. 5 subjected to this high temperature.
Figure 8:
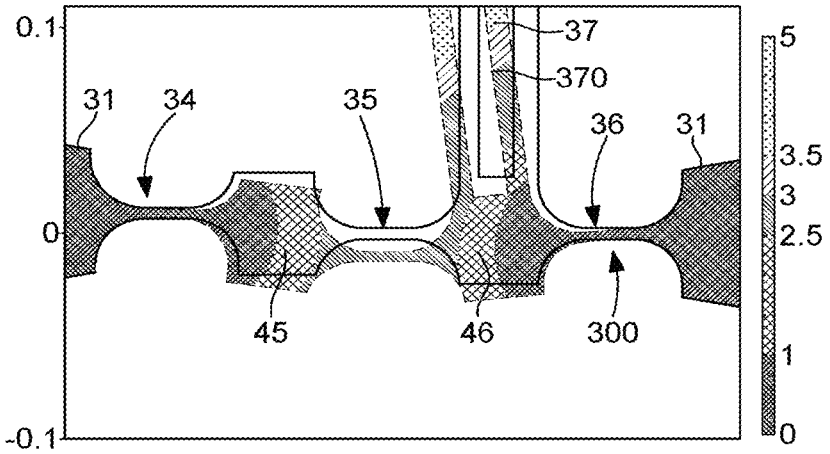
FIG. 8 is a detail showing the neck portions.

FIGS. 6 to 8 illustrate the deformation of an actuator as shown in FIG. 5, and FIGS. 9 and 10 respectively illustrate the displacement CC of distal end 380 of stick 37, and the distribution of stress S in neck portions 34, 35, 36, as a function of the temperature in heating area 6.

FIGS. 12 and 13 concern the calculation of the rate adjustment to be made by wheel/inertia block 20, made of single crystal silicon, a non-limiting numerical example of which will be given hereinafter. The external diameter is 0.7 mm, with a distance from the centre to the flat of the eccentric unbalance x1=0.1 mm, a thickness of 150 μm, a density of (Si) 2330 kg/m$^3$, a radius of action of the weights Rm=4 mm, and the number of teeth of click wheel 21 Z=50.

There is thus obtained, in this specific case: 1 step=44 μm, 1 revolution of the wheel=13.6 seconds per day, one linear adjustment area=11 seconds per day, which corresponds to 15 levels=number of actuator clicks, 1 click=0.74 seconds per day.

FIG. 13 illustrates the variation of rate in seconds per day, between the upper and lower limits of the linear range at +5.52 and −5.52 s/d, as a function of the angle of rotation a of wheel/inertia block 20.

This microsystem is well suited to MEMS manufacturing technology or similar, in a non-limiting manner since any other suitable technology and/or materials known to those skilled in the art may be envisaged for manufacture, for example using laser cutting, water jet cutting, electrical discharge machining or other methods.

Although the invention is described here with two microsystems 10 operating in the same direction, it is clear that equipped balance 70 can be equipped with microsystems 10 making inertia corrections in opposite directions to each other, if necessary.

To modify inertia, the system according to the invention is reversible, since by rotating wheel/inertia block 20 in an uninterrupted manner, the inertia is modified according to a sine function as seen in FIG. 13, which avoids being bidirectional. The only drawback in this case is that, to achieve a lower inertia, when in the increasing inertia phase in the direction of activation of the click, it is necessary to rotate through a little less than one complete revolution to achieve the correct value.

In a particular embodiment, microsystem 10 comprises a first level formed by base plate 60 around a heat insulation cavity 41, and a second level comprising at least one wheel/inertia block 20, at least one actuator 30, at least one first active click 38, and at least one means 25 (or second passive click) for stopping toothing 21 in position.

In an advantageous variant, base plate 60 and thermomechanical actuator 30 are made of the same material, to avoid being thrown out of adjustment when base plate 60 and thermomechanical actuator 30 are subjected, inside a watch, to the same temperature variations due to the external environment in which the user of the watch is moving.

In a particular embodiment, microsystem 10 is made in one-piece and comprises cavities under the moving members comprised therein.

In a particular embodiment, microsystem 10 is entirely made of silicon and/or silicon oxide. It may also be made of DLC or of other micromechanical materials.

In a particular embodiment, the first level is a "handle" level and the second layer is a "device" layer.

Different variants may be made, and in particular an entirely silicon microsystem 10, notably comprising cavities under clicks 25 and 38 so that they can be made in MEMS technology, and advantageously comprising a wheel/inertia block 20 on flexible pivots, evidently with a limited angular travel in this latter case.

The embodiments of FIGS. 3 and 5 utilise silicon-on-insulator (SOI) wafers with two silicon levels, for example with a thickness of 500 μm for the handle substrate forming base plate 60 and a thickness of 150 μm for the device layer (actuator 30, wheel 20, clicks 25 and 38, stops 39).

In a variant, a single-level mechanism may be made, for example of thickness 300 μm, and with flexible pivots of the inertia element and recesses carefully positioned for heat insulation. In this variant, a return-to-zero system must be added when the maximum value is reached, since the angular travel is limited.

Account should also be taken of the forces, stresses and/or torques generated during shocks of up to a maximum of 500 g during wear which must not throw the system out of adjustment, which requires a minimum force to be provided by actuator 30 to prevent any misadjustment caused by a random acceleration.

The invention also concerns a timepiece oscillator 100 comprising at least one such microsystem 10. The base plate 60 of the at least one micro-system 10 is attached to an oscillator component to regulate the inertia thereof in order to correct the rate of the oscillator.

More specifically, oscillator 100 includes an equipped balance 70 formed by a bare balance 7 connected to an elastic return means or subjected to at least one field of repulsion and/or of attraction, bare balance 7 carrying at least one such microsystem 10 or being in one-piece with at least one such microsystem 10.

The invention also concerns a timepiece movement 200 comprising at least one such oscillator 100. Movement 200 comprises at least one crystal 2 transparent to predetermined wavelength ranges, and allowing the passage of a light ray 3 for the adjustment of at least one such microsystem 10.

The invention also concerns a watch 1 comprising at least one such microsystem 10 or one such oscillator 100. This watch 1 comprises at least one crystal 2 transparent to predetermined wavelength ranges, and allowing the passage of a light ray 3 for the adjustment of such a microsystem 10, which controls a mechanical component for setting a function of the watch, such as setting the time, date, time zone or suchlike. The control member of at least one microsystem 10 comprised in watch 1 is arranged to control a mechanical component for setting a time-related function of watch 1 when microsystem 10 is subjected to suitable light radiation.

In a particular application, the only means for setting watch 1 are these microsystems 10, and adjustment is achieved in a contactless manner, without subjecting the watch to a magnetic or electrostatic field, and occurs simply through the application of energy from at least one light ray.

The invention also concerns a device 1000 for setting the rate of a timepiece oscillator comprising at least one such watch 1. This device 1000 comprises control means 300, arranged to control the emission of a light ray 3 towards an optical concentrator 4, guiding a light beam to an illuminated area 5 of watch 1 through crystal 2, inside which illuminated area 5 a heating area 6 can be superposed on a central area of thermomechanical actuator 30 to initiate a motion of at least one wheel/inertia block 20 when the concentrated light energy is applied to heating area 6.

More particularly, this device 1000 comprises rate monitoring means 400 arranged to be disposed on or in proximity to a case 90 of watch 1, and heat monitoring means 500 arranged to be disposed on or in proximity to said case 90, and control means 300 are arranged to generate light rays 3 only when the temperature of case 90 is lower than a reference value, and are arranged to generate light rays 3 when heating area 6 is superposed on the central area of thermomechanical actuator 30, as many times as necessary while the variation of rate is different from a reference value. It is understood, in fact, that the system is an impulsive system, and that the generation of light rays is not continuous, in order to limit the temperature inside case 90.

In short, the invention enables the rate to be adjusted extremely precisely, without requiring the case to be opened. Moreover, this adjustment is discreet and therefore reproducible.

Although the preferred application of the invention is for setting an oscillator, it can also be applied to other timepiece applications, since it allows adjustments to be made in a watch that is closed and perfectly sealed, which is particularly advantageous for divers watches or suchlike, where simple adjustments to set the time or the date may henceforth be achieved without any push-buttons or control means passing through the case.

What is claimed is:

1. A microsystem for setting the rate of a timepiece oscillator, comprising at least one wheel/inertia block arranged to pivot with respect to a base plate comprised in said microsystem, said wheel/inertia block comprising an off-centre unbalance and comprising a toothing, said microsystem comprising at least one actuator arranged to drive at least a first active click formed by a click arranged to drive a control wheel, a lever, or a click wheel, said active click being arranged to drive said toothing, and said microsystem comprising at least one means for stopping said toothing in position, wherein at least one said actuator is an optically controlled thermomechanical actuator arranged to convert a flow of light energy into a displacement of a control member comprised in said thermomechanical actuator, which control member carries a said first active click or directly controls a movement of a first said active click.

2. The microsystem according to claim 1, wherein said at least one means for stopping said toothing in position is a second click arranged to be returned towards said toothing by an elastic return means comprised therein.

3. The microsystem according to claim 1, wherein said at least one first active click is a click mounted tangentially to said toothing and comprises at least one tooth returned towards said toothing by an elastic return means comprised therein.

4. The microsystem according to claim 1, wherein said thermomechanical actuator comprises, substantially in a first longitudinal direction a longitudinal line composed of alternating stiff weights and flexible neck portions maintained between anchor elements on said base plate, and in that a central area of said thermomechanical actuator comprising at least said neck portions is arranged to be superposed on a heating area where said central area can receive an application of light energy capable of compressing said longitudinal line between said anchor elements and of causing at least one of said neck portions to bend.

5. The microsystem according to claim 4, wherein at least one of said flexible neck portions is offset, in a transverse direction orthogonal to said longitudinal direction, by a transverse offset with respect to said other neck portions, converting the bending motion of at least one of said neck portions into a plane rotational motion, parallel to said base plate, of at least one intermediate weight not directly connected to one of said anchor elements.

6. The microsystem according to claim 5, wherein said intermediate weight that is drivable in rotation, carries a stick extending substantially in said transverse direction and comprising a distal end forming said control member.

7. The microsystem according to claim 6, wherein the rotational travel of said stick is limited by stick stops which surround said lever.

8. The microsystem according to claim 6, wherein said thermomechanical actuator carries, substantially in the extension of said stick and on the opposite side with respect to a line defined by said anchor elements, at least one counterweight intended to prevent motion of said stick in the event of shocks.

9. The microsystem according to claim 8, wherein said central area comprises the inner end of said counterweight which is separated from the distal end thereof by a cavity arranged to insulate said distal end from a hot area when said central area is subjected to a flow of light energy.

10. The microsystem according to claim 6, wherein said central area comprises the inner end of said stick which is separated from said distal end by a cavity arranged to insulate said distal end from a hot area when said central area is subjected to a flow of light energy.

11. The microsystem according to claim 4, wherein said central area comprises the inner ends of two arms directly attached via the outer ends thereof to said anchor elements wherein said inner ends are separated by recesses arranged to insulate said anchor elements from a hot area when said central area is subjected to a flow of light energy.

12. The microsystem according to claim 4, wherein said base plate comprises at least one cavity arranged to insulate a hot area from said base plate and from said at least one wheel/inertia block when said central area is subjected to a flow of light energy.

13. The microsystem according to claim 1, wherein said base plate and said thermomechanical actuator are made of the same material to avoid being thrown out of adjustment when said base plate and said thermomechanical actuator are subjected, inside a watch, to the same temperature variations.

14. The microsystem according to claim 1, wherein at least one said wheel/inertia block is mounted to pivot about a fixed axis affixed to said base plate or incorporated in said base plate.

15. The microsystem according to claim 1, wherein at least one said wheel/inertia block is incorporated in said base plate with respect to which said wheel/inertia block pivots carried by monolithic articulated structures or flexible bearings.

16. The microsystem according to claim 1, wherein said microsystem comprises a first level formed by said base plate and a second level comprising at least one said wheel/inertia block, at least one said actuator, at least one said first active click, and at least one said means for stopping said toothing in position.

17. The microsystem according to claim 16, wherein said first level is a handle layer and in that said second level is a device layer.

18. The microsystem according to claim 1, wherein said microsystem is made in one-piece and comprises cavities underneath the movable members comprised therein.

19. The microsystem according to claim 18, wherein said microsystem is made entirely of silicon and/or silicon oxide.

20. A timepiece oscillator comprising at least one microsystem according to claim 1, wherein said base plate of said at least one microsystem is attached to a component of said oscillator to adjust the inertia thereof in order to correct the rate of said oscillator.

21. The oscillator according to claim 20, wherein said oscillator comprises an equipped balance formed by a bare balance connected to an elastic return means or subjected to at least one field of repulsion and/or of attraction, said bare balance carrying at least one said microsystem or being in one-piece with at least one said microsystem.

22. A timepiece movement comprising at least one oscillator according to claim 20, wherein said movement comprises at least one crystal transparent to predetermined wavelength ranges, and allowing the passage of a light ray for setting a said microsystem.

23. A watch comprising at least one microsystem according to claim 1, wherein said watch comprises at least one crystal transparent to predetermined wavelength ranges, and allowing the passage of a light ray for setting at least one said microsystem.

24. The watch according to claim 23, wherein said watch comprises at least one said microsystem wherein said control member is arranged to control a mechanical component for setting a time-related function of said watch when said microsystem is subjected to suitable light radiation.

25. The watch according to claim 23, wherein the only means for setting time-related functions comprised in the watch are formed by at least one said microsystem whose control member is arranged to control a mechanical component for setting a timerelated function of said watch when said microsystem is subjected to suitable light radiation.

26. A device for setting the rate of a timepiece oscillator, comprising at least one watch according to the claim 23, wherein said device comprises control means arranged to control the emission of a light ray towards an optical concentrator guiding a light beam towards an illuminated area of said watch through said crystal, inside which illuminated area a heating area can be superposed on a central area of said thermomechanical actuator to initiate a motion of at least one said wheel/inertia block when the concentrated light energy is applied to said heating area.

27. The device according to claim 26, wherein said device comprises rate monitoring means arranged to be disposed on or in proximity to a case comprised in said watch, and heat monitoring means arranged to be disposed on or in proximity to a case, and in that said control means are arranged to generate said light rays only when the temperature of said case is lower than a reference value, and are arranged to generate said light rays when said heating area is superposed on said central area of said thermomechanical actuator, as many times as necessary until the variation of rate is lower than a reference value.

28. The device according to claim 26, wherein said device comprises synchronizing means for controlling a said light ray to follow the motion of and to target at least one said microsystem borne by a component of said oscillator during the oscillation thereof.

* * * * *